US011247496B2

(12) United States Patent
Neeb et al.

(10) Patent No.: US 11,247,496 B2
(45) Date of Patent: Feb. 15, 2022

(54) DEVICE FOR CONTROLLING AN INKJET PRINTING MACHINE TO PROVIDE A VARIABLE DISTANCE BETWEEN AN INKJET PRINT HEAD AND A SUBSTRATE

(71) Applicant: HEIDELBERGER DRUCKMASCHINEN AG, Heidelberg (DE)

(72) Inventors: Steffen Neeb, Bensheim (DE); Nicklas Raymond Norrick, Heddesheim (DE); Andreas Henn, Neckargemuend (DE); Jens Forche, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/577,087

(22) Filed: Sep. 20, 2019

(65) Prior Publication Data

US 2020/0094594 A1 Mar. 26, 2020

(30) Foreign Application Priority Data

Sep. 21, 2018 (DE) ..... 10 2018 216 117.8

(51) Int. Cl.

| | |
|---|---|
| ***B41J 25/308*** | (2006.01) |
| ***B41J 25/304*** | (2006.01) |
| ***B41J 11/00*** | (2006.01) |

(52) U.S. Cl.

CPC ..... *B41J 25/308* (2013.01); *B41J 11/0095* (2013.01); *B41J 25/304* (2013.01); *B41J 2203/011* (2020.08)

(58) Field of Classification Search

CPC .... B41J 25/308; B41J 11/0095; B41J 25/304; B41J 2203/011

See application file for complete search history.

(56) References Cited

U.S. PATENT DOCUMENTS

| | | | |
|---|---|---|---|
| 6,421,073 | B1 | 7/2002 | Dietel et al. |
| 6,543,868 | B2 | 4/2003 | Cooper et al. |
| 7,398,733 | B2 | 7/2008 | De Vries et al. |
| 7,735,991 | B2 | 6/2010 | Asano |
| 8,449,065 | B2 | 5/2013 | Nakayama |
| 8,827,409 | B2 | 9/2014 | Nakamura |
| 9,815,307 | B2 | 11/2017 | Mueller et al. |
| 10,252,552 | B2 | 4/2019 | Pitz et al. |
| 10,328,725 | B2 | 6/2019 | Knauf et al. |

(Continued)

FOREIGN PATENT DOCUMENTS

| | | | |
|---|---|---|---|
| CN | 1233563 | A | 11/1999 |
| CN | 1449332 | A | 10/2003 |

(Continued)

*Primary Examiner* — Yaovi M Ameh

(74) *Attorney, Agent, or Firm* — Laurence A. Greenberg; Werner H. Stemer; Ralph E. Locher

(57) ABSTRACT

A device for controlling the printing operation in an inkjet printing machine includes at least one inkjet print head disposed at an adjustable distance from a substrate to be printed on. A device receives a print job and a bad sheet sensor has a trigger threshold. A machine control unit adjusts the distance between the inkjet print head and the substrate to be printed on as well as the trigger threshold of the bad sheet sensor before or after the printing operation as a function of a received print job.

8 Claims, 1 Drawing Sheet

(56) References Cited

U.S. PATENT DOCUMENTS

| | | | | |
|---|---|---|---|---|
| 2004/0008230 | A1* | 1/2004 | Kelley | B41J 25/308 347/8 |
| 2007/0127090 | A1 | 6/2007 | Nonaka | |
| 2008/0049088 | A1 | 2/2008 | Codos | |
| 2010/0187753 | A1* | 7/2010 | Suzuki | B65H 7/02 271/265.02 |
| 2016/0103632 | A1* | 4/2016 | Kawaguchi | B41J 3/60 347/19 |
| 2016/0288544 | A1 | 10/2016 | Writt et al. | |

FOREIGN PATENT DOCUMENTS

| | | | |
|---|---|---|---|
| CN | 1666882 | A | 9/2005 |
| CN | 1861412 | A | 11/2006 |
| CN | 1950210 | A | 4/2007 |
| CN | 103660617 | A | 3/2014 |
| CN | 105383185 | A | 3/2016 |
| CN | 106541715 | A | 3/2017 |
| CN | 107878019 | A | 4/2018 |
| DE | 102017211533 | A1 | 4/2018 |
| EP | 0983862 | A2 | 3/2000 |
| EP | 2871059 | A1 | 5/2015 |
| JP | H11334172 | A | 12/1999 |
| JP | 2011167859 | A | 9/2011 |

* cited by examiner

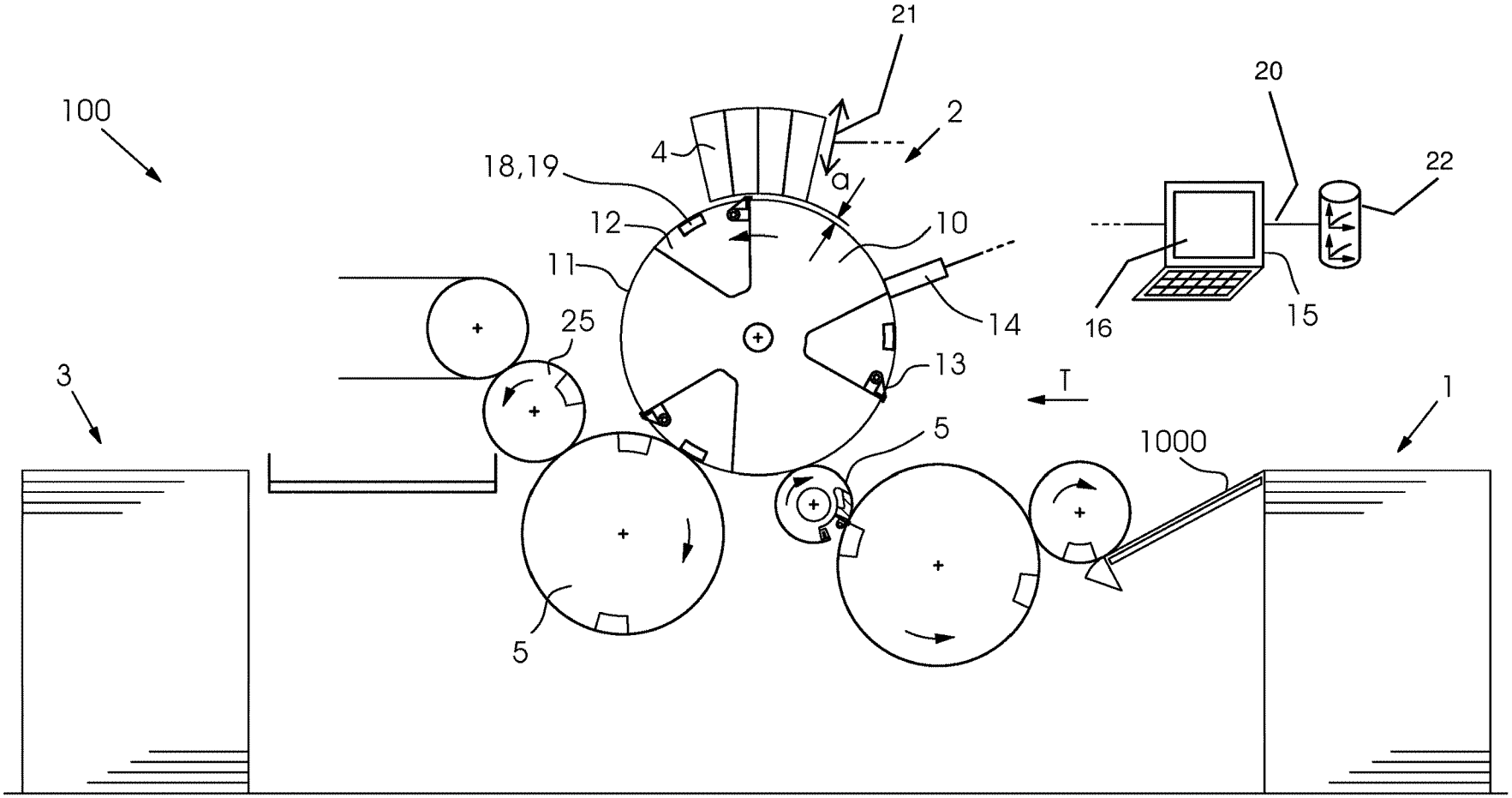
22
20
15
16
1
1000
T
14
2
10
13
5
21
a
4
12
18,19
11
25
5
100
3

DEVICE FOR CONTROLLING AN INKJET PRINTING MACHINE TO PROVIDE A VARIABLE DISTANCE BETWEEN AN INKJET PRINT HEAD AND A SUBSTRATE

CROSS-REFERENCE TO RELATED APPLICATION

This application claims the priority, under 35 U.S.C. § 119, of German Patent Application DE 10 2018 216 117.8, filed Sep. 21, 2018; the prior application is herewith incorporated by reference in its entirety.

BACKGROUND OF THE INVENTION

Field of the Invention

The present invention relates to a device for controlling the printing operation of an inkjet printing machine, including at least one inkjet print head disposed at an adjustable distance from a substrate to be printed on, a bad sheet sensor, a machine control unit and a device for receiving a print job.

German Patent Application DE 10 2017 211 533 A1, corresponding to U.S. Pat. No. 10,328,725, discloses an inkjet printing machine with a device of that general type for controlling the printing operation. The inkjet printing machine described therein includes a print head that is height-adjustable to adjust the distance between the print head and the substrate to be printed on during the printing operation. In addition, the control unit of the inkjet printing machine may automatically lift the height-adjustable print head by using a drive and a mechanism when the printing substrate has raised corners or waves that would cause the print head to contact the substrate if the position of the inkjet print head was not changed. Such contact needs to be avoided at all costs because the outside of an inkjet print head is very sensitive to any type of contact in the environment of the printing nozzles. Any such contact may destroy an inkjet print head. In order to detect waves or protruding parts of a printing substrate, German Patent Application No. DE 10 2017 211 533 A1, corresponding to U.S. Pat. No. 10,328,725, describes the provision of a so-called bad sheet sensor that detects protruding corners or waves in a printing substrate and may thus anticipate expected collisions between the inkjet print head and the printing substrate. When such a collision seems imminent, a drive is actuated based on the information of the bad sheet sensor to lift the inkjet print head high enough to avoid the collision. As a result, a dangerous printing substrate will not be printed on and will be ejected from the machine unprinted. Such a printing substrate thus constitutes waste, which in turn needs to be minimized to optimize the productivity of the machine. That means that the bad sheet sensor must make sure that only print sheets that are truly a danger to the print head are taken out and not printing substrates that are still admissible to the printing operation.

In addition, European Patent Application EP 0 983 862 A2, corresponding to U.S. Pat. No. 6,543,868, discloses an inkjet printing machine with an inkjet print head disposed at a distance from the printing substrate which is automatically adjusted as a function of the characteristics of the printing substrate. For this purpose, the height of the inkjet print head including its mount may be adjusted by a slight rotary movement. Such a device may be used to factor in the different thicknesses of printing substrates when the correct distance between the inkjet print head and the substrate is set. Waves or protruding corners in the printing substrate cannot be detected because no bad sheet sensor is provided.

European Patent Application EP 2 871 059 A1 furthermore discloses an inkjet printing machine that is capable of printing on a wide variety of objects on a tray. In that case, too, the distance between the inkjet print head and the object is controlled through the printing operation. For that purpose, a sensor measures at least one parameter that factors in the thickness of the object to be printed on and may thus be used for height adjustments. However, it is not the inkjet print head itself which has an adjusted height but the tray that is moved up or down. Again there is no bad sheet sensor for detecting print sheets that may cause problems.

SUMMARY OF THE INVENTION

It is accordingly an object of the invention to provide a device for controlling the printing operation in an inkjet printing machine with at least one inkjet print head, which overcomes the herein afore-mentioned disadvantages of the heretofore-known devices of this general type and which on one hand allows different print jobs to be processed by using different printing substrates and on the other hand ensures that even with these different print jobs, waste is minimized because a bad sheet sensor that is provided to detect dangerous printing substrates does not give false positives.

With the foregoing and other objects in view there is provided, in accordance with the invention, a device for controlling the printing operation in an inkjet printing machine, the device including at least one inkjet print head disposed at an adjustable distance from a substrate to be printed on, a bad sheet sensor, a machine control unit, and a device for receiving a print job, wherein the machine control unit adapts the distance between the inkjet print head and the substrate to be printed on and a trigger threshold of the bad sheet sensor as a function of the received print job before or during the printing operation.

This is a way to ensure that different print jobs, in particular print jobs with different printing substrates, may be processed with minimum waste because the characteristics of the different print jobs are automatically factored in to adapt the trigger threshold of the bad sheet sensor to the respective print job. This may be done before a print job is processed, for instance when an identical printing substrate is to be used, but also while a print job is being processed that envisages varying printing substrates, for example. The characteristics of the print job include the nature of the printing substrate and the inks that are used but also the desired quality of the print. The higher the print quality requirements, the shorter the distance between the inkjet print head and the substrate needs to be during the printing operation. However, the shorter distance causes the bad sheet sensor to be triggered more often because even small waves or corners in the printing substrate that are folded upward may pose a threat to the inkjet print head and thus trigger the bad sheet sensor more often.

A first embodiment of the present invention envisages that the height of the inkjet print head is adjustable by using a drive connected to the machine control unit. Due to the fact that the height adjustment drive of the inkjet print head is connected to the machine control unit, the inkjet print head may be adapted to the characteristics of the print job quickly and in an automated way by the machine control unit both before and during a printing operation.

A further embodiment of the present invention envisages that print jobs are subdivided into different categories with different distances between the inkjet print head and the printing substrate and that these categories are saved on the machine control unit. These categories may then be assigned to different degrees of printing quality. For instance, for high printing quality, it is possible to define a distance of 650 μm and a trigger threshold of 400 μm for the bad sheet sensor. In a second category of medium printing quality, the distance is 850 μm and the trigger threshold for the bad sheet sensor is 600 μm. For very low printing quality, a third category may be created with a distance of 1000 μm and a trigger threshold of 800 μm for the bad sheet sensor. The distance, the trigger threshold, and the number of categories are only given herein by way of example and are not to be understood as being final. The important aspect is that apart from increasing the distance, the threshold for triggering the bad sheet sensor may be increased. This means much less waste.

Moreover, it is advantageously envisaged that the device for receiving a print job includes an input device, in particular a touch screen, for an operator to make inputs. In this embodiment of the present invention, an operator may select a specific category or input specific characteristics such as the desired print quality and characteristics of the printing substrate or of the ink that is used into the machine control unit by using an input device such as a touch screen. The machine control unit then sets the appropriate distance between the printing substrate and the inkjet print head and adapts the trigger threshold of the bad sheet sensor in a suitable way. Alternatively or additionally, it may be envisaged that the device for receiving a print job includes an interface with a pre-print department for transmitting print job data. In this case, the characteristics of the print job may be transmitted to the machine control unit of the inkjet printing machine through an interface with the pre-print department and/or with an MIS system in a fully automated way without any operator intervention, enabling the machine control unit to automatically calculate the suitable settings of the distance between the inkjet print head and the printing substrate as well as the trigger threshold for the bad sheet sensor. If desired, the settings that have been calculated in this way may be displayed on a screen for an operator to acknowledge them and subsequently, once the operator's acknowledgment has been given, for them to be used in the machine control unit.

A further embodiment of the present invention envisages that the machine control unit detects the occurrence of bad sheets and displays a message proposing a greater distance between the inkjet print head and the substrate on a screen when a threshold saved in the machine control unit is exceeded. In this advantageous embodiment of the present invention, the machine learns to optimize the distance between the inkjet print head and the printing substrate and the associated trigger threshold on the basis of the frequency of the occurrence of bad sheets that may endanger the inkjet print head. Then the distance between the inkjet print head and the substrate may be increased within the printing quality requirements to reduce the occurrence of waste. Starting from a specific frequency threshold saved on the machine control unit, the machine control unit proposes an optimized distance between the inkjet print head and printing substrate by a corresponding display on a screen. In this case, too, an opportunity for the operator to acknowledge the proposal may be provided and the optimized distance is actually not set until the operator has acknowledged it. Alternatively, the improved distance may be set in an automated way.

In a particularly advantageous embodiment of the present invention, the distance between the inkjet print head and the substrate as well as the trigger threshold of the bad sheet sensor before or during the printing operation depend on the characteristics of the printing substrate. The characteristics of the printing substrate, such as the thickness of the substrate and the torsional stiffness, are major influences on the dangers to the inkjet print head. For thicker printing substrates, for instance, the distance between the jetting cylinder and the inkjet print head needs to be adapted to accommodate the thickness of the substrate. On the other hand, the distance between the inkjet print head and the printing substrate may be reduced because a thicker printing substrate is less likely to become wavy and have protruding edges, thus reducing the danger to the print head. Therefore, the trigger threshold of the bad sheet sensor needs to be adapted to prevent unnecessary waste that is created when unprinted printing substrates are ejected.

Other features which are considered as characteristic for the invention are set forth in the appended claims.

Although the invention is illustrated and described herein as embodied in a device for controlling an inkjet printing machine to provide a variable distance between an inkjet print head and a substrate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

The figure of the drawing is a diagrammatic, longitudinal-sectional view of an inkjet printing machine with a bad sheet sensor and a height-adjustable inkjet print head.

DETAILED DESCRIPTION OF THE INVENTION

Referring now in detail to the single figure of the drawing, there is seen a sheet-fed printing machine 100 constructed as a digital printing machine. A respective sheet 1000 is fed-in by a feeder 1 in order to be transported through a printing unit 2 to a delivery 3, in a direction of transport T. Cylinders, namely transfer cylinders 5 and a jetting cylinder 10, are the major devices for transporting a respective sheet 1000. Multiple inkjet print heads 4 that are electrically height-adjustable are disposed at a short distance a above the jetting cylinder 10 in order to print on a sheet 1000 that is moved past by the jetting cylinder 10 at the short distance a. The jetting cylinder 10 may also be referred to as a printing cylinder.

In the illustrated embodiment, the jetting cylinder 10 has three sheet-holding regions 11 which are separated from one another by respective gaps 12. Grippers 13 hold the sheets 1000 on the sheet-holding regions 11. Measurement scales 18, 19 are provided in the gaps 12.

A machine control unit or controller 15 having a user interface and a memory 22 is provided to control the printing machine 100 and in particular the height-adjustable inkjet print heads 4. A drive 21 connected to the machine control unit 15 adjusts a height of the inkjet print head 4. As described above, a device for receiving a print job may include an input device, in particular a touch screen 16, for an operator to make inputs and therefore the device may be part of the machine control unit 15. However, a device for receiving a print job may also be an interface 20 with a pre-print department for transmitting print job data. A sensor system 14 is disposed upstream of the inkjet print heads 4 as viewed in the direction of transport T. The sensor system 14 continuously monitors the sheets 1000 and the measurement scales 18, 19 and is also referred to as a bad sheet sensor. The sensor system 14 is disposed in the path of sheet travel and is likewise connected to the machine control unit 15. The sensor system 14 may monitor the traveling of the sheets, in particular the printing material thickness d, i.e. how far the sheets 1000 protrude beyond the sheet-holding areas 11. In this way, creases, dog ears, folds, waves, and sheets 1000 that are held insufficiently or badly may be detected. A data communication link is provided between the sensor system 14 and the machine control unit 15, which also includes a sensor control unit. The sensor system 14 needs to be disposed sufficiently far upstream of the inkjet print heads 4 for a collision between a sheet 1000 and inkjet print heads 4 to be avoided even if a problem occurs at the trailing edge of the sheet, for instance by stopping the machine 100, lifting the inkjet print heads 4, or ejecting the defective sheet 1000 (not illustrated). An ejection drum 25 for ejecting defective sheets, e.g. sheets 1000 with an incomplete print, is disposed downstream of the jetting cylinder 10.

The machine control unit 15 receives the data of a print job to be executed on the sheet-fed printing machine 100 by using a touch screen or a pre-print interface. In this process, the machine control unit 15 analyzes the print job in terms of print quality, characteristics of the printing substrate, and other properties to be able to calculate a suitable distance between the sheets 1000 and the inkjet print head 4. In addition, the machine control unit 15 calculates the trigger threshold of the sensor system 14 as a function of the characteristics of the print job. Aspects that are taken into consideration in particular include the thickness and stiffness of the printing material because these characteristics are important in describing the danger of waves, bent edges, and dog-eared corners of the sheet 1000. In addition, multiple categories for categorizing print jobs may be saved on the machine control unit 15. High-quality print jobs may, for instance, be assigned to a class requiring a comparatively short distance between the inkjet print head 4 and the sheet 1000 and a correspondingly low trigger threshold for the sensor system 14. A category of medium-quality print jobs uses a greater distance and a correspondingly higher trigger threshold for the sensor system 14. Low-quality print jobs may use an even greater distance and a higher trigger threshold in order further to reduce waste caused by bad sheets 1000, i.e. sheets that are problematic. The device of the invention may in principle be used in all inkjet printing machines in which the distance between the inkjet print head 4 and the print sheets 1000 may be adjusted by adjusting the height of either the inkjet print head 4 or the printing cylinder 10 and which include a bad sheet sensor.

The following is a summary list of reference numerals and the corresponding structure used in the above description of the invention:

1 feeder
2 printing unit
3 delivery
4 inkjet print head
5 transfer cylinder
10 printing cylinder (jetting cylinder)
11 sheet-holding area/sheet-supporting surface
12 gap
13 gripper
14 sensor system
15 machine control unit with sensor control
16 touch screen
18 measuring gauge (AS)
19 measuring gauge (BS)
20 interface
21 drive
22 memory
25 ejection drum
100 sheet-fed printing machine
1000 sheet
a distance
T direction of transport

The invention claimed is:

1. A device for controlling a printing operation in an inkjet printing machine, the device comprising:
- at least one inkjet print head disposed at an adjustable distance from a substrate to be printed on;
- a bad sheet sensor having a trigger threshold;
- a device for receiving print job data; and
- a machine control unit adapting said distance between said inkjet print head and the substrate to be printed on and adapting said trigger threshold of said bad sheet sensor as a function of received print job data including inks being used before or during the printing operation.

2. The device according to claim 1, which further comprises a drive connected to said machine control unit for adjusting a height of said inkjet print head.

3. The device according to claim 1, wherein said machine control unit includes a memory for storing print jobs subdivided into various categories of different distances between said inkjet print head and the printing substrate.

4. The device according to claim 1, wherein said device for receiving a print job includes an input device for inputs made by an operator.

5. The device according to claim 4, wherein said input device is a touch screen.

6. The device according to claim 1, wherein said device for receiving a print job includes an interface with a pre-press device for transmitting print job data.

7. The device according to claim 1, wherein said machine control unit records an occurrence of bad sheets and displays a message on a screen when a threshold saved on said machine control unit is exceeded to propose a greater distance between said inkjet print head and the substrate.

8. The device according to claim 1, wherein said distance between said inkjet print head and the substrate as well as said trigger threshold of said bad sheet sensor before or during the printing operation are dependent on characteristics of the printing substrate.

* * * * *